US009133788B2

(12) United States Patent
Bando

(10) Patent No.: US 9,133,788 B2
(45) Date of Patent: Sep. 15, 2015

(54) RECIPROCATING ENGINE

(75) Inventor: Shigeru Bando, Tokushima (JP)

(73) Assignee: BANDO KIKO CO., LTD., Tokushima (JP)

( * ) Notice: Subject to any disclaimer, the term of this patent is extended or adjusted under 35 U.S.C. 154(b) by 0 days.

(21) Appl. No.: 13/576,510

(22) PCT Filed: Jan. 28, 2011

(86) PCT No.: PCT/JP2011/000500

§ 371 (c)(1), (2), (4) Date: Aug. 1, 2012

(87) PCT Pub. No.: WO2011/093106

PCT Pub. Date: Aug. 4, 2011

(65) Prior Publication Data

US 2012/0298084 A1 Nov. 29, 2012

(30) Foreign Application Priority Data

Feb. 1, 2010 (JP) ..... 2010-020781
Aug. 4, 2010 (JP) ..... 2010-175804

(51) Int. Cl.
*F02F 3/00* (2006.01)
*F02B 25/08* (2006.01)
(Continued)

(52) U.S. Cl.
CPC . *F02F 3/00* (2013.01); *F02B 77/04* (2013.01); *F02F 3/042* (2013.01); *F02F 3/08* (2013.01)

(58) Field of Classification Search
CPC ..... F05C 2201/021; F05C 2201/0448; F02F 3/22; F02B 75/28; F02B 2075/025; F02B 75/04; F01B 3/0005; F01B 3/0079; F01L 5/10; F02D 15/04; F02D 15/02
USPC ..... 123/73 AA, 69 V, 61 V, 303, 41.34, 289
See application file for complete search history.

(56) References Cited

U.S. PATENT DOCUMENTS 4,741,543 A * 5/1988 Geffroy et al. ..... 277/434
5,265,565 A 11/1993 Bando
(Continued)

FOREIGN PATENT DOCUMENTS

CN 1745239 3/2006
CN 101424226 5/2009
(Continued)

OTHER PUBLICATIONS

International Search Report for PCT/JP2011/000500, mailed Mar. 8, 2011.
(Continued)

*Primary Examiner* — Lindsay Low
*Assistant Examiner* — Syed O Hasan
(74) *Attorney, Agent, or Firm* — Nixon & Vanderhye P.C.

(57) ABSTRACT

A reciprocating engine is so arranged that, in an initial period of an expansion stroke, a high-pressure combustion gas above a piston is introduced via gas passage holes provided in an upper portion of a cylinder inner surface on a thrust side into a gas chamber defined by the cylinder inner surface and a top ring, a second ring, and a second land of the piston, so as to support the piston from the thrust side by the introduced high-pressure combustion gas. A half ring is inserted in the gas chamber in a state of being placed on the second land from the thrust side and so as to be movable up and down with clearances above and below, whereby as the piston reciprocates, the half ring moves up and down an amount corresponding to the size of the clearances, thereby continually cleaning the inside of the gas chamber.

2 Claims, 3 Drawing Sheets

(51) Int. Cl.

| | |
|---|---|
| ***F01L 5/10*** | (2006.01) |
| ***F02B 75/04*** | (2006.01) |
| ***F02F 3/04*** | (2006.01) |
| ***F02F 3/08*** | (2006.01) |
| ***F02B 77/04*** | (2006.01) |

(56) References Cited

U.S. PATENT DOCUMENTS

| | | | | |
|---|---|---|---|---|
| 5,755,192 | A * | 5/1998 | Brevick | 123/78 B |
| 5,894,824 | A | 4/1999 | Watanabe et al. | |
| 7,464,683 | B2 * | 12/2008 | Bando | 123/193.6 |
| 7,637,214 | B2 * | 12/2009 | Beck et al. | 104/284 |
| 7,637,241 | B2 * | 12/2009 | Styron | 123/193.6 |
| 7,931,003 | B2 | 4/2011 | Bando | |
| 8,069,833 | B2 | 12/2011 | Bando | |
| 2006/0070597 | A1 | 4/2006 | Bando | |
| 2009/0107447 | A1 | 4/2009 | Styron | |

FOREIGN PATENT DOCUMENTS

| | | |
|---|---|---|
| JP | 04-347353 | 12/1992 |
| JP | 4-362258 | 12/1992 |
| JP | 05-026106 | 2/1993 |
| JP | 2009-114927 | 5/2009 |

OTHER PUBLICATIONS

Chinese Office Action issued in corresponding Chinese Patent Application No. 2011800072748 issued on Jan. 20, 2014.

* cited by examiner

RECIPROCATING ENGINE

This application is the U.S. national phase of International Application No. PCT/JP2011/000500, filed 28 Jan. 2011, which designated the U.S. and claims priority to Japan Application No. 2010-020781 filed 1 Feb. 2010, and Japan Application No. 2010-175804, filed 4 Aug. 2010, the entire contents of each of which are hereby incorporated by reference.

TECHNICAL FIELD

The present invention relates to improvements of a reciprocating engine in which, in an explosion and expansion stroke, a piston is supported (floated by gas pressure) by a high-pressure combustion gas in opposition to the lateral pressure acting on the piston, so as to reduce the frictional resistance between the piston and a cylinder.

BACKGROUND ART

Techniques described in Patent Documents 1 to 4 are such that a gas chamber is formed around a second land portion of the piston, and during an initial period of the explosion and expansion stroke a high-pressure combustion gas from above the piston is introduced into and held in this gas chamber through gas passage holes provided in a cylinder inner surface, whereby the piston is supported from a thrust side by this high-pressure combustion gas introduced and held, to thereby reduce frictional resistance between the piston and the cylinder inner surface.

PRIOR ART DOCUMENTS

Patent Documents

Patent Document 1: WO 92/02722

Patent Document 2: WO 2004/079177

Patent Document 3: European Patent Application EP1878901

Patent Document 4: WO 2008/047453

SUMMARY OF THE INVENTION

Problems That the Invention Is To Solve

However, during the operation of the engine, the introduction, holding, and discharge of the high-pressure combustion gas from above the piston are repeated in the aforementioned gas chamber. Then, adhesion and deposition of carbon on the surface of the gas chamber gradually occurs.

Accordingly, an object of the present invention is to provide a reciprocating engine in which adhesion and deposition of carbon does not occur in the gas chamber even when the engine is operated over long periods of time and the introduction, holding, and discharge of the high-pressure combustion gas are repeated in the aforementioned gas chamber.

Means for Solving the Problems

In accordance with the present invention, there is provided a reciprocating engine in which, in an initial period of an expansion stroke, a high-pressure combustion gas from above a piston is introduced via gas passage holes provided in an upper portion of a cylinder inner surface on a thrust side into a gas chamber formed by being encompassed by the cylinder inner surface and a top ring, a second ring, and a second land of the piston, so as to support the piston from the thrust side by the introduced high-pressure combustion gas, said reciprocating engine comprising: a half ring which is inserted in the gas chamber in a state of being placed on the second land from the thrust side and so as to be movable up and down with clearances above and below, whereby as the piston reciprocates, the half ring moves up and down an amount corresponding to a size of the clearances, thereby continually cleaning an inside of the gas chamber.

In the reciprocating engine in accordance with the present invention, even if the gas chamber is subjected to the repeated introduction, holding, and discharge of the high-pressure combustion gas, since the half ring always continues its up-down movement inside the gas chamber to effect cleaning action, the adhesion and deposition of carbon does not occur inside the gas chamber.

In the present invention, the half ring may be formed of a heat-resistant metal plate made of such as stainless steel or spring steel. In a preferred example of the present invention, however, the half ring is formed of a metal plate, such as one formed of stainless steel, which is higher in heat insulating properties than a material for forming the piston which is formed of an aluminum alloy or the like.

In such an example, since the half ring has heat resistance, the high-pressure combustion gas introduced into the gas chamber can be kept at a high temperature, with the result that the occurrence of adhesion and deposition of carbon in the gas chamber can be prevented more satisfactorily.

It should be noted that, in the reciprocating engine in accordance with the present invention, the aforementioned terms "above and below" and "up-down movement" means movement along the reciprocating direction of the piston.

Advantages of the Invention

Even if the gas chamber is subjected to the repeated introduction, holding, and discharge of the high-pressure combustion gas, since the half ring always continues its up-down movement inside the gas chamber to effect cleaning action, the adhesion and deposition of carbon does not occur inside the gas chamber, and the introduced high-pressure combustion gas can be kept at a high temperature.

MODE FOR CARRYING OUT THE INVENTION

Figure 1:
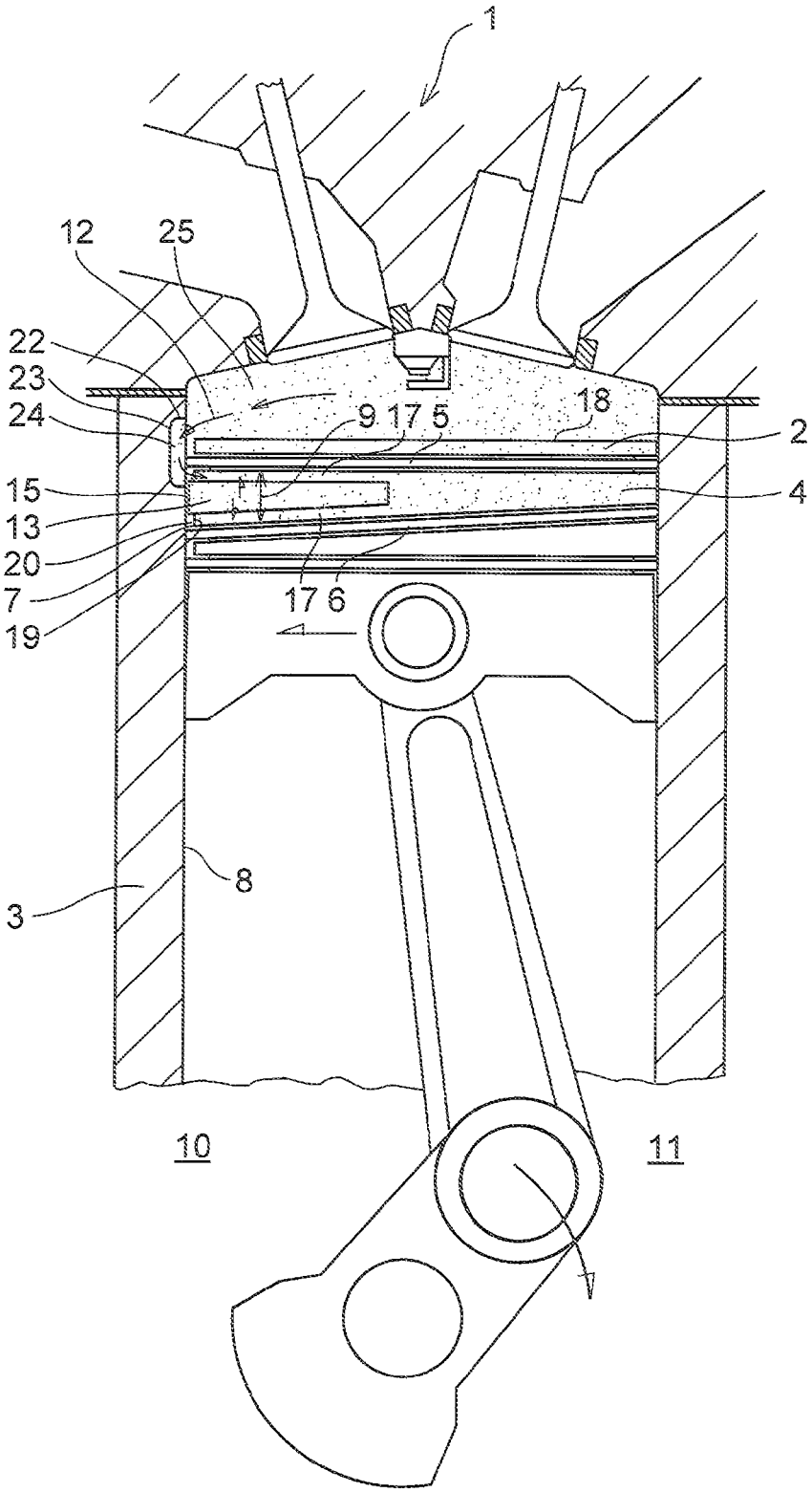
FIG. 1 is an explanatory longitudinal cross-sectional view of a reciprocating engine in accordance with an embodiment of the invention.

Hereafter, a description will be given of the mode for carrying out the present invention with reference to an embodiment illustrated in the drawings.

Embodiment

Figure 2:
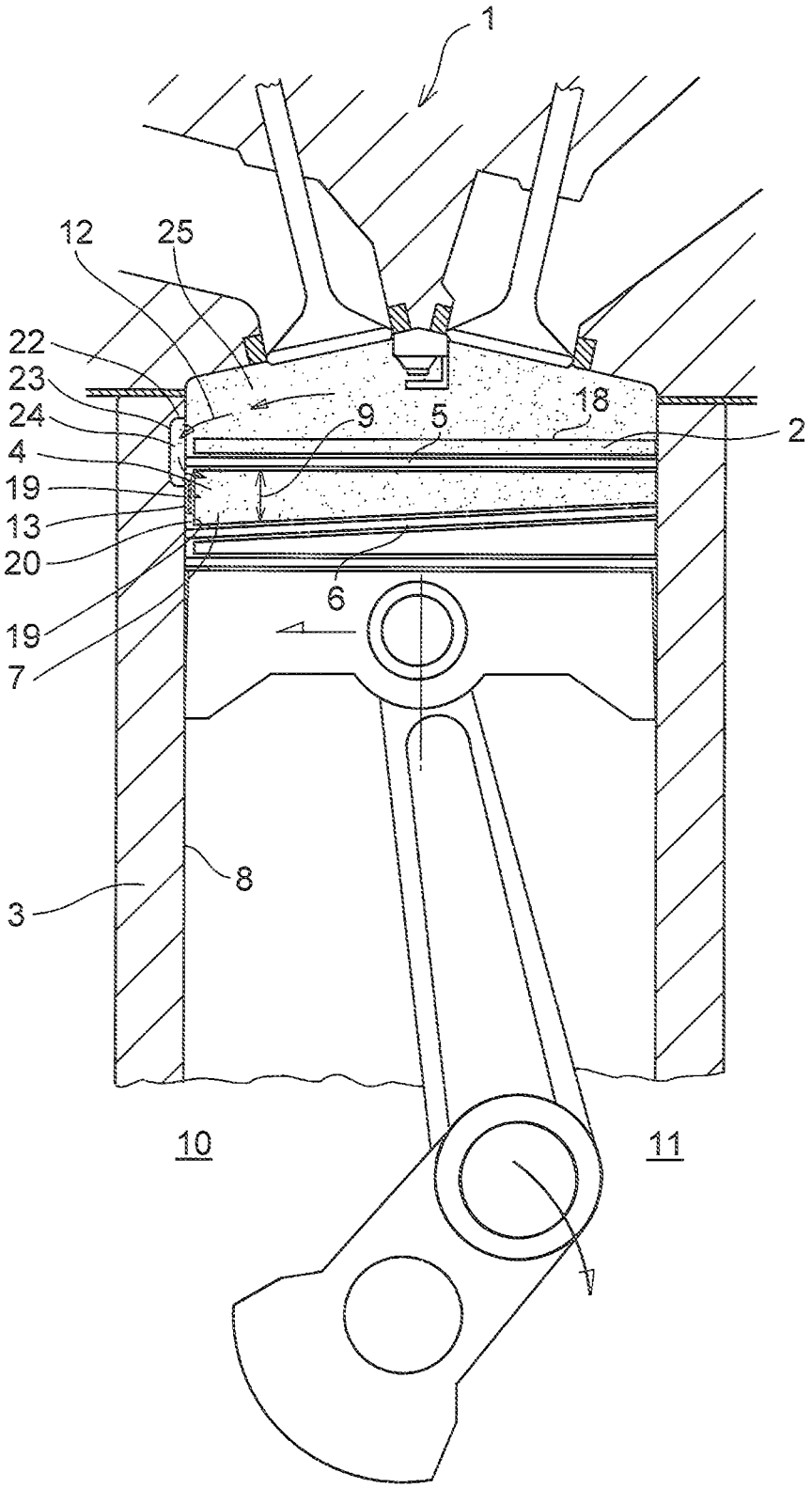
FIG. 2 is an identical explanatory longitudinal cross-sectional view in which a half ring in FIG. 1 is shown in a cutaway manner.

FIGS. 1 and 2 show a state during an initial period of a lowering stroke of a piston 2 in an explosion and expansion stroke.

FIGS. 1 and 2 show a reciprocating engine 1 in accordance with this embodiment in an initial period of the explosion and expansion stroke.

Reference numeral 2 denotes the piston, and reference numeral 3 denotes a cylinder. Further, reference numeral 4 denotes a gas chamber.

The gas chamber 4 is formed by being encompassed by a cylinder inner surface 8 and a top ring 5, a second ring 6, and a second land 7 of the piston 2. As for the gas chamber 4, its vertical width 9 is wider on a thrust side 10 and narrower on an anti-thrust side 11.

This is to ensure that, by making a gas-pressure receiving area wider on the thrust side 10 and narrower on the anti-thrust side 11, the piston 2 is supported from the thrust side 10 (in opposition to the lateral pressure of the piston) by a high-pressure combustion gas 12 introduced and held, to thereby make the pushback from the anti-thrust side 11 small.

In the gas chamber 4, a circular arc-shaped half ring 13 is inserted in a state of being placed on the second land 7 from the thrust side 10.

In addition, the half ring 13 is inserted in such a manner as to be movable up and down with clearances 17 above and below (in the reciprocating direction of the piston 2) inside the gas chamber 4.

Figure 3:
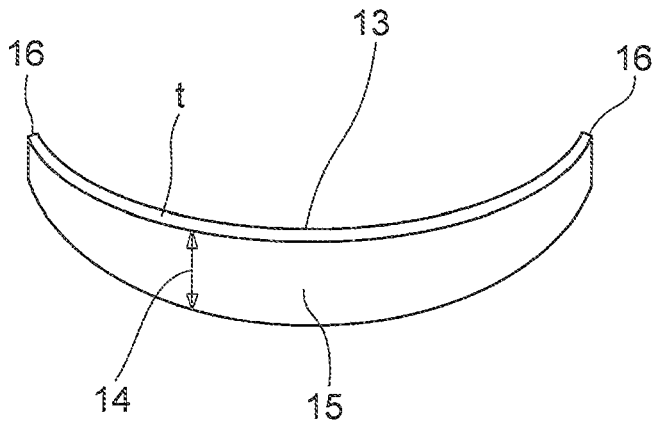
FIG. 3 is a perspective view of the half ring shown in FIGS. 1 and 2.

As shown in FIG. 3, the half ring 13 is formed in a circular arc shape conforming to the circumferential surface of the second land 7.

In addition, as for the half ring 13, its front side and lateral sides are formed such that its vertical width 14 is made wide in a front central portion 15 and narrower at both side ends 16 in conformity with the shape of the gas chamber 4.

Further, the vertical width 14 of the half ring 13, as a whole, is made shorter than the vertical width 9 of the gas chamber 4. This is to allow the clearances 17 to be created above and below in a state in which the half ring 13 is inserted in the gas chamber 4. The half ring 13 moves up and down inside the gas chamber 4 an amount corresponding to the distance of these clearances 17.

As shown in FIGS. 1 and 2, the half ring 13 is inserted in the gas chamber 4 with its front central portion 15 matched with the thrust side 10.

In particular, during the operation of the engine, the half ring 13 is moved up and down by the reciprocating movement of the piston 2 so as to vertically sweep the surface of the second land 7 for forming the gas chamber 4.

In addition, the thickness t of the half ring 13 is such a thickness that, during the operation of the engine, the half ring 13 can freely move up and down (along the reciprocating direction of the piston 2) within a clearance 20 between the cylinder inner surface 8 and a surface 19 of the second land 7.

In addition, the half ring 13 is formed of a metal plate, such as one formed of stainless steel, which is higher in heat insulating properties than a material for forming the piston 2 which is formed of an aluminum alloy or the like.

It should be noted that, with respect to the piston 2 of the reciprocating engine 1 in accordance with this embodiment, the top ring 5 for forming the gas chamber 4 is provided in parallel to a piston top surface 18, while the second ring 6 is provided in such a manner as to be inclined cowardly toward the thrust side 10. Namely, the second ring 6 is provided in such a manner as to be located away from the top ring 5 on the thrust side 10 and to be located closer to the top ring 5 as it approaches the anti-thrust side.

Accordingly, the interval (distance) between the top ring 5 and the second ring 6, i.e., the vertical width 9 of the gas chamber 4, is wider on the thrust side 10 and becomes gradually narrower as it approaches the anti-thrust side 11.

In addition, a plurality of gas passage holes 23 are provided in an upper portion 22 of the cylinder inner surface 8 on the thrust side 10. When the top ring 5 of the piston passes over the gas passage holes 23 in a lowering stroke of the piston 2, a combustion chamber 25 above the piston 2 and the gas chamber 4 of the piston 2 communicate with each other through recesses 24 of these gas passage holes 23, thereby allowing the high-pressure combustion gas 12 in the combustion chamber 25 to be introduced into and held in the gas chamber 4.

Namely, in the initial period of the explosion and expansion stroke, when the top ring 5 of the piston 2 passes the gas passage holes 23 in an upper portion of the cylinder inner surface 8, the combustion chamber 25 above the piston 2 and the gas chamber 4 of the piston 2 communicate with each other, so that the high-pressure combustion gas 12 is introduced into and held in the gas chamber 4.

At this juncture, the piston 2, upon receiving the action of the lateral pressure, tends to be pressed against the cylinder inner surface 8, but the piston is lowered during the lowering stroke in a state of being supported from the thrust side 10 (in opposition to the lateral pressure acting on the piston 2) by the high-pressure combustion gas introduced into and held in the gas chamber 4.

According to the reciprocating engine 1 in accordance with this embodiment, during the operation of the engine, i.e., while the piston 2 is reciprocating, the introduction (influx), holding, and discharge of the combustion gas 12 are repeatedly carried out in the gas chamber 4 of the piston 2, and the half ring 13 continues its up-down movement in this gas chamber 4, thereby continually effecting cleaning action inside the gas chamber 4. For this reason, although the gas chamber 4 is repeatedly subjected to the introduction and holding of the high-pressure combustion gas 12, the occurrence of adhesion and deposition of carbon inside the gas chamber 4, particularly on such as the surface 19 of the second land 7, is prevented by virtue of the cleaning action of the half ring 13.

DESCRIPTION OF REFERENCE NUMERALS

1: reciprocating engine
2: piston
3: cylinder
4: gas chamber
5: top ring
6: second ring
7: second land
8: cylinder inner surface
9: vertical width of gas chamber
10: thrust side
11: anti-thrust side
12: high-pressure combustion gas
13: half ring
14: vertical width of half ring
15: front central portion
16: both side ends
17: vertical clearance
18: piston top surface
19: surface of second land
20: clearance
22: upper portion
23: gas passage hole
24: recess
25: combustion chamber

The invention claimed is:

1. A reciprocating engine in which, in an initial period of an expansion stroke, a high-pressure combustion gas from above a piston is introduced via gas passage holes provided in an upper portion of an inner surface of a cylinder on a thrust side into a gas chamber which is defined by the piston, a top ring of the piston provided in parallel to a piston top surface in a reciprocating direction of the piston, a second ring provided in such a manner as to be inclined away from the top ring on a thrust side and to be inclined closer to the top ring as it approaches on an anti-thrust side in the reciprocating direction of the piston, and a second land of the piston and the inner surface of the cylinder, so as to support the piston from the thrust side by the introduced high-pressure combustion gas, said reciprocating engine comprising: a cleaning member which is disposed in the gas chamber in a state of being placed on the second land from the thrust side and so as to be movable up and down with clearances above and below, whereby as the piston reciprocates, the cleaning member moves up and down an amount corresponding to a size of the clearances with respect to the piston, thereby continually cleaning an inside of the gas chamber so as to prevent a carbon from being adhered to a surface of the second land, said cleaning member having both side ends and a front central portion between said both side ends, a vertical width of said front central portion being longer than that of the both side ends, said cleaning member being not constrained to the piston and the cylinder, so as to be freely moved up and down between the top ring and the second ring.

2. The reciprocating engine according to claim 1, wherein the cleaning member is formed of a half ring.

* * * * *

UNITED STATES PATENT AND TRADEMARK OFFICE

CERTIFICATE OF CORRECTION

PATENT NO. : 9,133,788 B2
APPLICATION NO. : 13/576510
DATED : September 15, 2015
INVENTOR(S) : Bando It is certified that error appears in the above-identified patent and that said Letters Patent is hereby corrected as shown below:

In the Claims

In claim 1, column 5, line 3, "a second ring provided" should be corrected to -- a second ring of the piston provided --

Signed and Sealed this
Fifteenth Day of March, 2016

Michelle K. Lee

Michelle K. Lee
*Director of the United States Patent and Trademark Office*